US006820744B2

(12) United States Patent
Hoffman

(10) Patent No.: US 6,820,744 B2
(45) Date of Patent: Nov. 23, 2004

(54) SKIN CARE PRODUCT DELIVERY SYSTEM

(75) Inventor: Lisa Hoffman, Los Angeles, CA (US)

(73) Assignee: LH Skin Care LLC, Los Angeles, CA (US)

( * ) Notice: Subject to any disclaimer, the term of this patent is extended or adjusted under 35 U.S.C. 154(b) by 181 days.

(21) Appl. No.: 10/061,882

(22) Filed: Feb. 1, 2002

(65) Prior Publication Data

US 2002/0104775 A1 Aug. 8, 2002

Related U.S. Application Data

(60) Provisional application No. 60/266,225, filed on Feb. 2, 2001, and provisional application No. 60/318,053, filed on Sep. 7, 2001.

(51) Int. Cl.[7] ..... B65D 85/00

(52) U.S. Cl. ..... 206/581; 206/823

(58) Field of Search ..... 206/229, 581, 206/823, 530, 531, 532; 132/317, 319, 320

(56) References Cited

U.S. PATENT DOCUMENTS

| | | | | |
|---|---|---|---|---|
| 3,924,748 A | * | 12/1975 | Braverman | 206/534.1 |
| 4,526,273 A | | 7/1985 | Tsuji et al. | 206/229 |
| 4,786,534 A | | 11/1988 | Aiken | 428/34.2 |
| 4,826,014 A | | 5/1989 | Schefer | 206/581 |
| 4,884,680 A | | 12/1989 | Israel et al. | 206/44.11 |
| 4,889,228 A | | 12/1989 | Gueret | 206/209 |
| 4,982,838 A | | 1/1991 | Fitjer | 206/209 |
| 5,005,697 A | * | 4/1991 | Jimbo et al. | 206/581 |
| 5,109,984 A | * | 5/1992 | Romick | 206/531 |
| 5,301,697 A | | 4/1994 | Gueret | 132/298 |
| 5,562,112 A | * | 10/1996 | Gunderman et al. | 206/823 |
| 5,713,381 A | | 2/1998 | Sloane | 132/312 |
| 5,791,482 A | | 8/1998 | Murphy et al. | 206/581 |
| 5,879,769 A | | 3/1999 | Greenland et al. | 428/35.7 |
| 5,906,822 A | | 5/1999 | Samour et al. | |
| 5,911,980 A | | 6/1999 | Samour et al. | |
| 5,918,608 A | | 7/1999 | Renna | 132/320 |
| 5,944,188 A | | 8/1999 | Grosskopf et al. | 206/466 |
| 6,024,222 A | * | 2/2000 | Friberg et al. | 206/531 |
| 6,103,040 A | | 8/2000 | Hunkeler | 156/226 |
| 6,189,698 B1 | * | 2/2001 | Asser | 206/581 |
| 6,412,640 B1 | * | 7/2002 | Destanque et al. | 206/581 |

OTHER PUBLICATIONS

Online Pharmacy Prescription medication, "Nordette 28", approved by FDA in Apr. 2000, 3 pages.*

FDA Drug Approvals for Apr. 2000, 23 pages.*

Brochure, Klocke of America, Inc., "Ultimate Sampling Solutions," undated, received by Applicant in Jul., 2002.

Elizabeth Arden three–sample package, "Ceramide Advanced Time Complex Capsules," undated, received by Applicant in Jul., 2002.

Estee Lauder lipstick sample package, "Gorgeous and way ahead of its time," undated, received by Applicant in Jul., 2002.

Mary Kay multiple–blister sample package, "Crème–to–powder foundation," undated, received by Applicant in Jul., 2002.

Christian Dior sample package, "Dior Prestige, Nectar de Beautè", undated, received by Applicant in Jul., 2002.

Clinique sample package, "Skin Types I/II", dated Mar. 29, 2002, received by Applicant in Jul., 2002.

* cited by examiner

*Primary Examiner*—Luan K. Bui
(74) *Attorney, Agent, or Firm*—Hickman Palermo Truong & Becker

(57) ABSTRACT

A skin care product delivery system is disclosed. In one embodiment, the system comprises a carrier cover, a product carrier that is removably affixed to the carrier cover, a plurality of spaced-apart cavities formed in the product carrier and protruding through corresponding holes in the carrier cover, a removable cover sealed over the cavities, and a quantity of skin care fluid in each of the cavities. The system thus provides a compact, efficient, sanitary, and spill-proof apparatus for carrying all skin care products that are appropriate for care of an individual over a period of time. Alternate embodiments provide various closure styles, package formats and product aliquots organized by time period or function.

13 Claims, 6 Drawing Sheets

SKIN CARE PRODUCT DELIVERY SYSTEM

CROSS-REFERENCE TO RELATED APPLICATIONS; PRIORITY CLAIM

This application claims benefit, under 35 U.S.C. §119(e), of Provisional Appln. Ser. No. 60/266,225, filed Feb. 02, 2001, and Provisional Appln. Ser. No. 60/318,053, filed Sep. 7, 2001, the entire contents of which are hereby incorporated by reference for all purposes as if fully set forth herein.

FIELD OF THE INVENTION

The present invention generally relates to carrying, storing and delivering quantities of skin care products and similar products. The invention relates more specifically to a skin care product delivery system.

BACKGROUND OF THE INVENTION

Individuals need a better method of transporting and using skin care products, either at home or away from home. Each individual may require the use of several functionally different skin care products each day, and at different times of the day. For example, an individual may use a cleanser, a moisturizing lotion, a toning lotion, an eye treatment, lip balm, a sun protective lotion, an astringent wash, or other products. Some of these products may be applied in the morning, while others are applied in the afternoon or evening. Having the proper products available at the proper time therefore becomes a complicated task.

In one past approach, an individual obtains separate individual containers of each skin care product and takes the containers with the individual during trips, errands or travel. However, using separate individual containers of skin care products tends to be awkward and messy. For liquid products, spills or leakage can occur, especially when the products are transported in a depressurized compartment, as on aircraft. They also take up an excessive amount of space and require the individual to have a large bag or other container to carry them.

These problems become acute when the individual is away from home or traveling. On a short trip, for example, the individual may need only a selected quantity of each product at a particular time, and yet the individual is required to carry numerous large containers just to have the selected quantity available when it is needed.

Further, when the individual is away from a home or other location where containers of products are located, desired products may be unavailable when they are needed.

Miniature product containers, known as "travel size" containers, have been used in the past for transporting smaller quantities of various personal care products. However the use of travel size products in the context described herein does not solve all existing problems. For example, in current approaches an individual is required to search for and apply only those products that are appropriate for the then-current time of day. Use of travel-size containers also requires the individual to travel with numerous separate product containers. Further, if the individual is traveling with numerous separate product containers, and needs only those products that are appropriate for morning, the individual is required to search for and identify the appropriate containers, and then dispense a selected quantity of only those products. This is time-consuming and cumbersome. If the individual needs a different combination of products in the afternoon or evening, the individual is required to repeat the foregoing exercise.

Yet another problem is that an individual may use different combinations of products for different activities. As an example, the combination of products that a particular individual uses for a summer day at the beach is probably quite different from the products that are appropriate for an evening in the city. The appropriate products also may vary by location, climate, or weather conditions.

Thus, there is a need for a way to transport, and make available for individual use, a selected quantity of a plurality of skin care products in a manner that is compact, convenient, sanitary, and neat.

There is also a need for a way to transport and make available such quantities of products in a manner that is organized for a particular time period of the day.

There is also a need for a way to transport and make available such quantities of products in a manner that is organized for a particular kind of activity.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

SUMMARY OF THE INVENTION

The foregoing needs, and other needs and objects that will become apparent for the following description, are achieved in the present invention, which comprises, in one aspect, a skin care product delivery system. In one embodiment, the system comprises a carrier cover, a product carrier that is removably affixed to the carrier cover, a plurality of spaced-apart cavities formed in the product carrier, a removable seal over the cavities, and a quantity of skin care fluid in each of the cavities.

According to one feature, each of the cavities contains a functionally different skin care fluid. In another feature, each different skin care fluid addresses a different skin care need that may arise in a period of time.

In yet another feature, the carrier cover comprises a planar sheet having holes through which the cavities may protrude, one or more score lines, and a slot for receiving a closure tab. A closure tab extends outwardly from the sheet and is joined to the sheet by a foldable score line. Folding the cover along the score line and inserting the closure tab into the slot results in forming a closed package that contains and carries the product carriers, by removably closing the cover over the sheet and the cavities. In a related feature, first and second separate product carriers are provided; the first product carrier carries a first plurality of cavities that hold a first set of skin care products for use during a first time period, and the second product carrier carries a second plurality of cavities that hold a second set of skin care products for use during a second time period. For example, the first plurality of cavities holds skin care products for use during morning or day, and the second portion holds skin care products for use during afternoon or evening.

In still another feature, the seal of the product carrier comprises a single planar sheet of sealing material that covers all the cavities. In another feature, the seal comprises a first planar sheet that covers cavities of the first product carrier, and a second planar sheet that covers cavities of the second product carrier. In another feature, the seal comprises a plurality of individual seals, each of the seals formed over a different one of the cavities. The seal may be once-removable, or re-sealable.

According to another aspect, a skin care delivery system comprises a carrier cover, a first product carrier and a second product carrier. A first plurality of spaced-apart cavities is formed in the first product carrier and a second plurality of spaced-apart cavities is formed in the second product carrier. A removable seal is affixed over one or more of the cavities. A first set of skin care products in the cavities of the first product carrier, and each product in the first set is functionally different and is appropriate for use during a morning time period. A second set of skin care products in the cavities of the second product carrier, and each product in the second set is functionally different and is appropriate for use during an afternoon or evening time period.

The system thus provides a compact, efficient, sanitary, and spill-proof apparatus for carrying all skin care products that are appropriate for care of an individual over a period of time. Alternate embodiments provide cavities of various numbers, sizes and shape, various closure styles, package formats and product aliquots organized by time period or function.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENT

A skin care product delivery system is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

I. Structural and Functional Overview

In one aspect, a skin care product delivery system is provided that efficiently addresses the daily skin care needs of an individual. The system comprises a carrier cover and a product carrier that carries a plurality of selected quantities or pre-measured aliquots of skin care products. The system is compact and convenient, easy to use, and portable. In this embodiment, the system provides the skin care products that an individual may ordinarily require for one entire day in a single slim package.

Alternative embodiments provide a selection of particular skin care products tailored to a particular activity of the user, e.g., beach, skiing, etc. Other embodiments provide a selection of products appropriate for a particular time of day, such as day or evening. Still other embodiments carry products for uses other than skin care, such as hair care.

The compact, space-saving form of certain embodiments is ideal for use when and wherever an individual finds carrying several containers of various products to be inconvenient or impractical. Embodiments provide the user with the flexibility to carry precisely the type and amounts of products necessary for a particular or selected occasion, for any desired time period ranging from one day to an extended period of travel. The system greatly reduces risk of spillage of products when multiple products are carried. The system may be disposed of or recycled once the user has finished using it.

II. Examples of Delivery Systems

Figure 1:
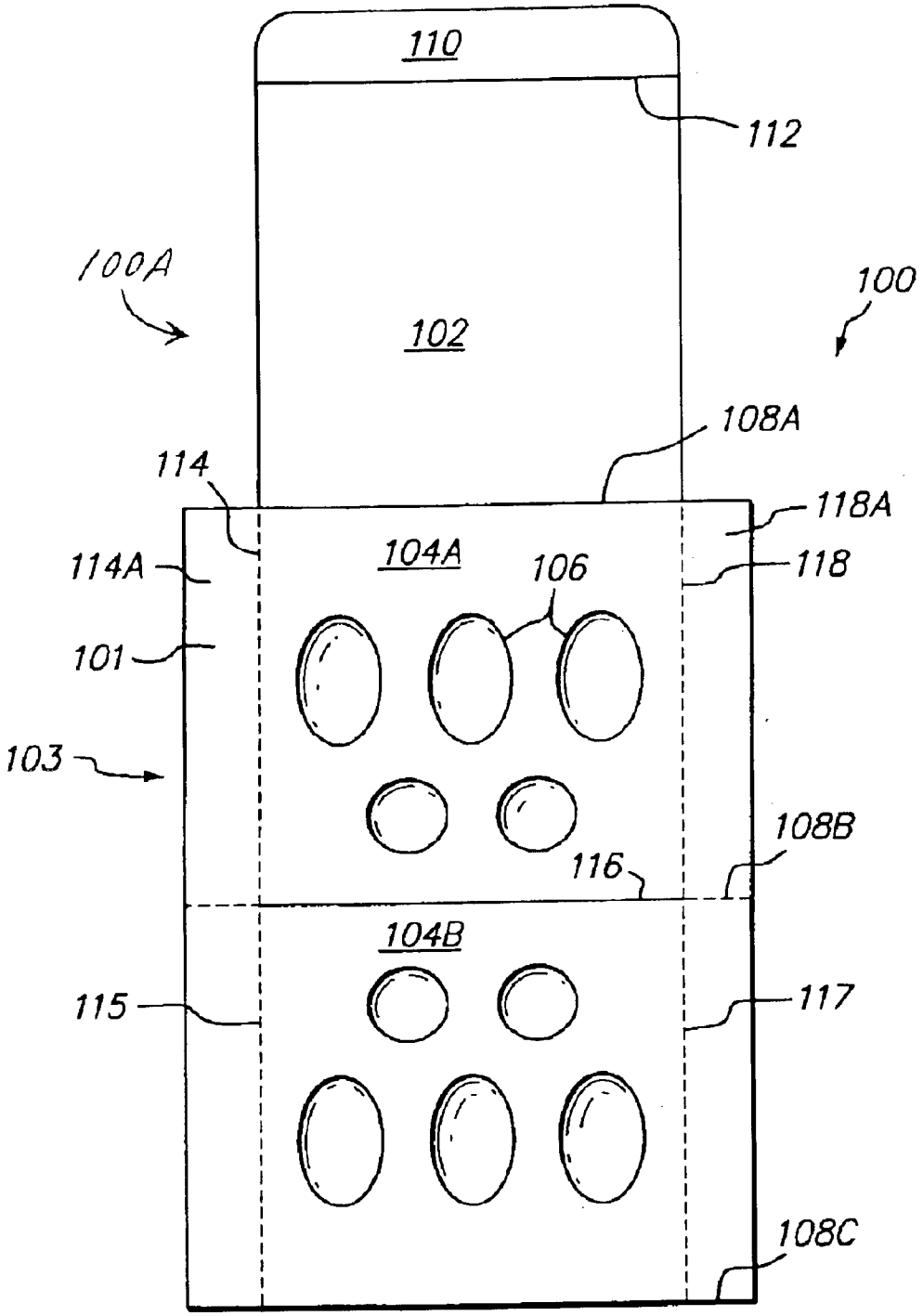
FIG. 1 is a diagram, in unfolded planar view, of a first embodiment of a skin care product delivery system.

FIG. 1 is a diagram, in unfolded planar view, of a first example embodiment of a skin care product delivery system. In this example embodiment, a skin care product delivery system 100 generally comprises a carrier cover 100A and a product carrier. The carrier cover 100A includes a front cover 102, a first carrier cover portion 104A, and a second carrier cover portion 104B. The product carrier is defined in part by a plurality of cavities 106 that protrude through corresponding holes in the cover portions 104A, 104B.

The cover portions 104A, 104B are formed integrally from a sheet material such as paperboard, cardboard, cardstock, etc. Each carrier cover portion 104A, 104B comprises top and bottom faces 101, 103; top face 101 may bear markings to identify the contents of the skin care products in cavities 106, or to identify their intended purpose, etc. Each carrier cover portion 104A, 104B has a plurality of holes through which project a plurality of cavities 106 of the product carrier; the cavities carry quantities of skin care products.

Figure 2A:
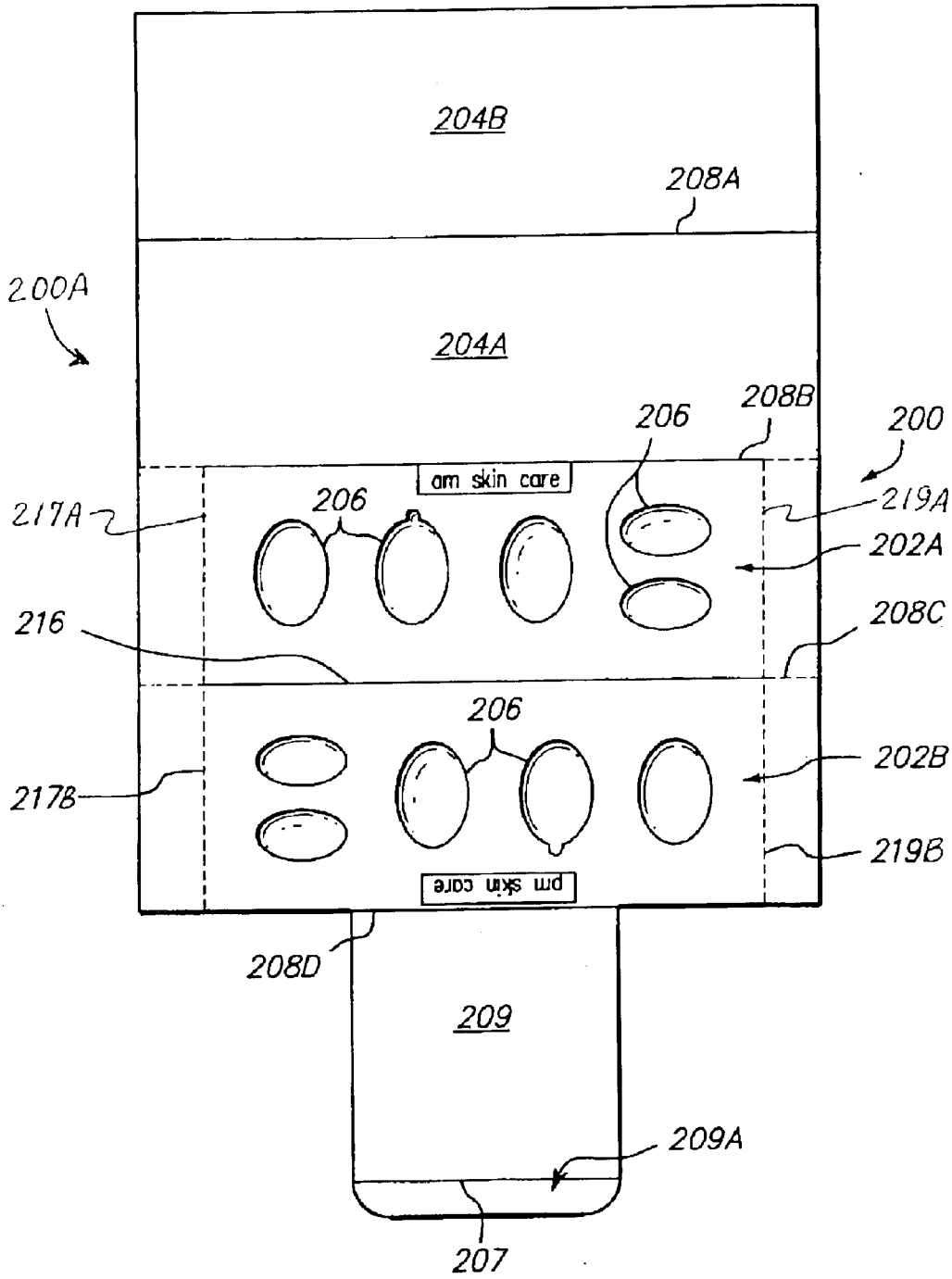
FIG. 2A is a diagram, in unfolded planar view, of a second embodiment of a skin care product delivery system.

The product carrier, in which cavities 106 are formed, an example of which is described in more detail herein with respect to FIG. 2A, is removably affixed against bottom face 103 so that cavities 106 are visible through the corresponding holes of top face 101 when the top face is viewed. In one embodiment, the holes are die-cut openings in the carrier cover. For purposes of illustrating an example, in FIG. 1 the holes and cavities are shown in oval and circular format, however, such format is not required, and the cavities may have any desired ornamental shape that is sufficient to contain a quantity of product, and the holes may have any desired corresponding ornamental shape.

The front cover 102 and carrier cover portions 104A, 104B are further defined by score lines 108A, 108B, 112, which may be used to fold and assemble the system in manufacturing. System 100 may include a generally rectangular tab 110 extending outward from front cover 102 and defined in part by a score line 112 in or adjoining the front cover. System 100 may include a linear slit 116 in the sheet 101 aligned on score line 108B that is configured to receive the tab 110.

Thus, when a product carrier is mounted behind each of the carrier cover portions 104A, 104B and the cavities 106 of the product carriers are filled with products and sealed with appropriate sealing material, the system 100 may be folded together on score lines 108A, 108B, 112, such that a distal end 108C of carrier cover portion 104B is folded under carrier cover portion 104A to meet score line 108A, front 102 is folded over carrier cover portion 104B, and the package is held in a closed arrangement by inserting tab 110 into slit 116. In this arrangement, a re-closable compact package is formed. To use products in cavities 106, the user opens or unfolds the package by removing the closure tab from the slit, tears open one or both of the perforations described below, removes one or both of the product carriers, removes the seal material from one or both of the product carriers, and applies the products. The carrier cover may be re-folded for storage, or the user may retain one or both product carriers separately and discard the carrier cover.

Carrier cover portions 104A, 104B may include adhesive or other means to sealingly close the system 100. A perforation 114, together with perforation 118 on the opposite side of the system, delineates the first carrier cover portion 104A that provides a sealed closure until opened by the user by separation along the perforations 114, 118. Similarly, a separate pair of perforations 115, 117 are provided to facilitate opening the second carrier cover portion 104B. Thus, by selectively tearing the perforations, a user may release only one product carrier from the system 100 while leaving the other affixed in place to its respective carrier cover.

In the example embodiment of FIG. 1, system 100 is organized as two carrier cover portions 104A, 104B each having a corresponding product carrier with cavities 106; in other embodiments, there may be any number of such carrier cover portions and corresponding product carriers, and there also may be only one carrier cover and corresponding product carrier. In one embodiment, a first carrier cover portion 104A is associated with skin care products for morning or daytime use and a second carrier cover portion 104B is associated with skin care products for afternoon or evening use.

The product carriers may be fabricated of water impermeable material or material that is impermeable to solvents or other liquids. The product carriers may be fabricated of polymer material, plastic, foil or other material suitable to form a leak-resistant, easily opened enclosure for skin care products carried by the product carriers. In one embodiment, a product carrier comprises a polystyrene sheet in which the product cavities 106 are formed, and a sealing layer of foil, adhesive-backed paper, or thin-film plastic.

Cavities 106 in the product carriers may be generally shallow. In one specific embodiment, there are from approximately 3 to 10 cavities, but there may be any number of cavities. The size of a cavity is not critical. In one specific embodiment, each cavity has an approximate depth of about 1 mm to 6 mm.

Further, the shape of the carrier cover, of the product carrier, and of each cavity, and the arrangement of cavities in a product carrier are not critical; the shape and arrangement of the cavities is primarily ornamental. The shape and arrangement of the corresponding holes is similarly ornamental. Cavities may be oval, circular, square, triangular, octagonal, rectangular, or formed in any other desired shape. Cavities may be arranged in any desired pattern or form, aligned orthogonally with respect to edges of the carrier package, or at an angle with respect to such edges. Elements of the system, such as the carrier cover or product carrier, may include a trademark, brand, logotype, or other identifying indicia in any desired location. Such elements may also bear information identifying the ingredients of the skin care products contained in the product carriers.

Each product carrier has one or more removable seals over the cavities, and a quantity of skin care product is provided in each of the cavities. In one embodiment, first and second seals are affixed over separate sets of cavities 106 for the product carriers that are associated with each of the carrier cover portions 104A, 104B. The seals are removable at least once, and water impermeable such that the products in the cavities 106 are fully sealed and contained in a sanitary manner. For example, a pull-tab seal, polyethylene or polypropylene films, metallic foils, and similar sealed peel-able materials may be used. The seals may be adhered with an adhesive compound or further covered with a shrink-wrap seal.

The seal may comprise a single sealing layer, or the seal may comprise a plurality of individual seals, each of the seals formed over a different one of the cavities. In still another embodiment, the seal may comprise a first sealing layer that overlies a secondary sealing layer. For example, the first sealing layer may be a thin-film plastic and the second sealing layer may be a foil layer. In this embodiment, a user obtains access by removing all or a portion of the first sealing layer associated with a desired skin care product, and then punctures or otherwise removes a portion of the second layer associated with the desired product.

Alternatively, the second sealing layer may comprise a backing having holes therein aligned with and corresponding to the cavities. This improves resistance to leakage without imposing a second seal that a user must open. In this alternative, a user obtains access to a desired product by removing only all or a portion of the first sealing layer associated with the desired product.

In still other embodiments, each cavity 106 is defined by a set of individual perimeter perforations that surround the cavity in the product carrier. In such an embodiment, a sub-portion of the product carrier associated with one particular cavity 106 may be individually separated from the remainder of the product carrier by tearing the perimeter perforations. The seal of the product carrier may have similar sets of individual perforations to facilitate removal of a portion of the seal associated with a desired product.

FIG. 2A is a diagram, in unfolded planar view, of a second example embodiment of a skin care product delivery system. FIG. 2A illustrates, as an example embodiment, the overall size and shape of a skin care product delivery system 200 and a typical size, shape and configuration of the skin care product cavities 206 and corresponding holes. System 200 generally comprises a carrier cover 200A consisting of first and second carrier cover portions 202A, 202B, first and second interior cover portions 204A, 204B, front cover 209, and closure tab 209A.

A re-closable, compact package may be formed by folding first and second carrier cover portions 202A, 202B, first and second interior cover portions 204A, 204B, front cover 209, and closure tab 209A along score lines 208A, 208B, 208C, 207, in effect "rolling up" the package 200. For example, interior cover portion 204B is folded under interior cover portion 204A; interior cover portions 204A, 204B are then folded as a unit under carrier cover portion 202A; interior cover portions 204A, 204B and carrier cover portion 202A are then folded as a unit under carrier cover portion 202B; front cover 209 is folded over carrier cover portion 202B; and a slit 216 snugly receives a closure tab 209A of front cover 209 to close the system and hold it in closed configuration.

Carrier cover portions 202A, 202B may comprise a plurality of holes through which project a corresponding plurality of cavities 206 in one or more product carriers that receive or hold skin care products. In the example of FIG. 2A, the kind of product in each cavity may be designated by labels or other matter printed or located adjacent to cavities 206 and/or their corresponding holes. In one embodiment, carrier cover portion 202A is associated with a first product carrier having a set of cavities holding products for morning or daytime ("a.m.") use, and carrier cover portion 202B is associated with a second product carrier having a set of cavities holding products for afternoon or evening ("p.m.") use. Interior cover portions 204A, 204B and front cover 209 may include one or more areas for a name, logo or other textual or graphic information or indicia or product ingredients; similarly, any of the carrier covers or product carriers also can bear ingredient information or other indicia.

Carrier cover portions 202A, 202B further include respective pairs of side perforations 217A, 219A and 217B, 219B. Left and right lateral extensions of score lines 208B, 208C may be perforated. Accordingly, when the system 200 is in a sealed and rolled-up arrangement, a user opens the system by removing closure tab 209A of front cover 209 from slit 216, tearing on the first pair of perforations 217A, 219A or the second pair of perforations 217B, 219B and the perforated lateral extensions of score lines 208B, 208C to separate one or both of the carrier cover portions 202A, 202B. The user may then withdraw one or both of the carrier packages from one or both of the carrier cover portions, and open one or both of the carrier packages to obtain the skin care products.

Figure 2B:
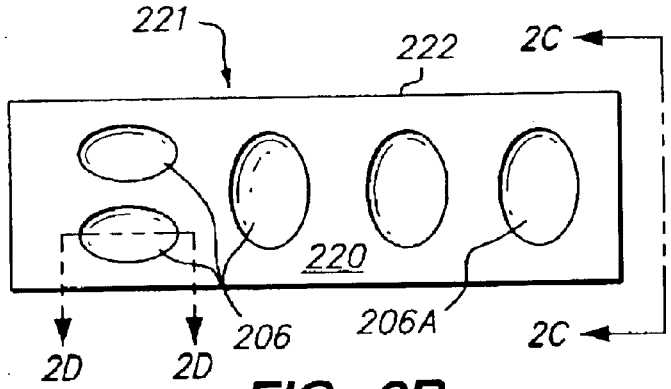
FIG. 2B is a top plan view of a product carrier for use in the product delivery system of FIG. 2A.

FIG. 2B is a top plan view of a product carrier that may be used with the embodiment of FIG. 2A. In one specific embodiment, a first product carrier of the configuration of FIG. 2B is removably affixed to carrier cover portion 202A, and a second product carrier of the same configuration is removably affixed to carrier cover portion 202B. Product carrier 221 generally comprises a water impermeable sheet 220 in which upwardly projecting bubble-like product cavities 206 are formed. Each of the cavities in this example embodiment comprises an oval that is formed in the sheet and spaced apart from other cavities; however, an oval format is not required. The underside of sheet 220 is covered with a seal 222, which may comprise a foil, thin-film plastic, etc.

Figure 2C:
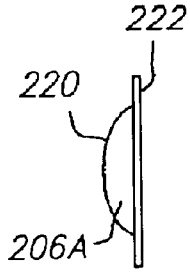
FIG. 2C is a side view of the product carrier of FIG. 2B taken along view lines 2C—2C of FIG. 2B.

FIG. 2C is a side view of the product carrier of FIG. 2B, taken along view lines 2C—2C of FIG. 2B. FIG. 2C illustrates an example of the approximate dimensions of cavity 206A of FIG. 2B. In this example, cavity 206A is formed in and extends upwardly from sheet 220 to form a bubble-like or dome-like cavity that can receive a product, and is covered by seal 222.

Figure 2D:
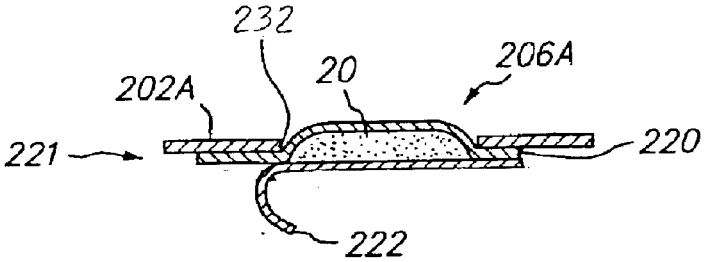
FIG. 2D is a partial section view of the product carrier of FIG. 2B, taken along line 2D—2D of FIG. 2B.

FIG. 2D is a partial section view of one cavity of the embodiment of FIG. 2A, taken along line 2D–2D of FIG. 2B, and illustrating the relationship of a carrier cover and associated product carrier with product cavities. The first carrier cover portion 202A of FIG. 2A is affixed to product carrier 221 such that sheet 220 lies snugly against seal 222 so that cavity 206A projects through a hole 232 in carrier cover portion 202A.

Each cavity 206 contains a selected or pre-measured amount of a particular kind of skin product 20. In one specific embodiment, each different cavity 206 contains a functionally different skin care product, and the quantity of each product is sufficient for one complete use for a particular period of time or activity. Thus, the various cavities of each product carrier of the delivery system contain the skin care products useful or necessary for a period of time, such as one day.

In one embodiment, each cavity in a plurality of cavities contains a quantity of a liquid or semi-liquid skin care product such as skin cleanser, toning lotion, moisturizing lotion, eye care product and lip balm. In other embodiments, the cavities may contain cosmetics, hair care products, other personal care products, medications, or other materials.

In any of the foregoing embodiments, a skin care delivery system may be offered for purchase with vacuum wrap or shrink-wrap over the entire substrate, and in single or multiple count packs. The carrier covers, product carriers and other elements of such a card or package of the delivery system may be manufactured, for example, from commercially available materials or post-consumer products. The entire system, or elements of the system, may be disposable or re-usable.

The overall size of the systems described herein may vary widely in length and width. According to one embodiment, carrier cover portions 202A, 202B have a dimension of about three inches (7.5 cm) to about seven inches (17.5 cm) or more. The thickness of the carrier cover portions with product carriers inserted therein generally is small with respect to the length or width dimension. In one embodiment, the thickness of the system is about one quarter inch (6 mm). However, the foregoing dimensions are not critical, and may vary significantly from the values given.

Figure 2E:
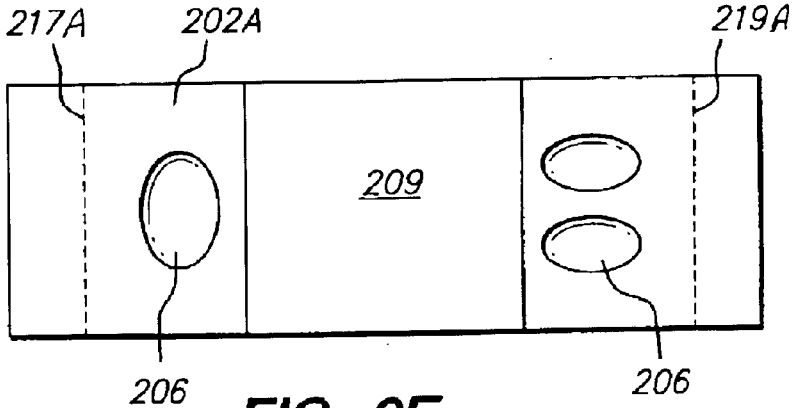
FIG. 2E is a top plan view of the exterior of the embodiment of FIG. 2A, in folded configuration.

FIG. 2E is a diagram of the exterior of the embodiment of FIG. 2A in a folded or closed configuration. In this arrangement, front cover 209 and its indicia are visible on the exterior of the package, as are certain sealed product cavities 206 of carrier cover portion 202A. In closed configuration, an individual may open the system by removing closure tab 209A from slit 216 and then tearing on perforations 217A, 219A to gain access to the first product carrier within the first carrier cover portion 202A. The user may then break or tear open seal 222 to obtain a skin care product.

Side regions of the carrier cover portions 202A, 202B may have adhesive thereon to form a package that remains sealed until it is first used. Perforations 217A, 219A, 217B, 219B then enable the closed, sealed package to be opened by tearing along the perforations. The adhesive may be permanent or resealable.

The seal for cavities of the product carriers may comprise a polymeric, plastic or other suitable material that can provide a sanitary and secure seal. Each cover may have a plurality of seals disposed therein that correspond to and are oriented directly below cavities 206 when the cover is applied to sheet 220. Each of the seals may be a separate peel-able or otherwise removable seal, or may be formed integral and continuous with seal 222 such that the entire seal is removed as a unit by a user. The seals may be formed of transparent, color-coded material so that the function of a product in an associated cavity is suggested or indicated by the color of the material.

In still another embodiment, seal 222 may comprise the combination of a first sealing layer that overlies a secondary sealing layer. For example, the first sealing layer may be a thin-film plastic and the second sealing layer may be a foil layer. Alternatively, the second sealing layer may comprise a backing having holes therein aligned with and corresponding to the cavities.

Similarly, cavities 206 may be arranged in a plurality of spaced-apart areas that are defined by lines, colors, graphics, or other elements to identify the products in the cavities.

Figure 3A:
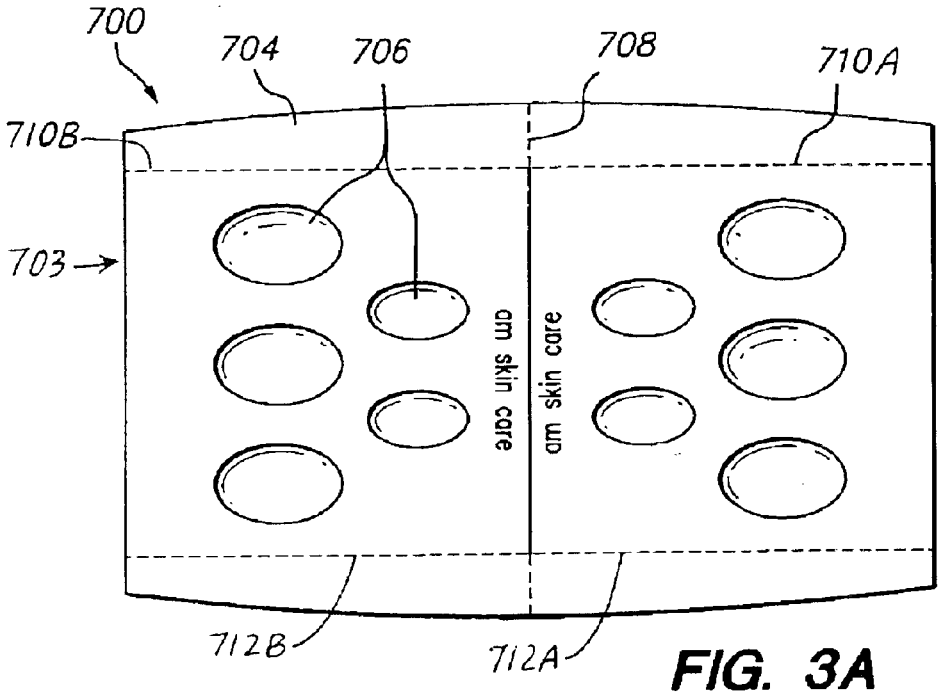
FIG. 3A is a plan view of a first side of a third embodiment of a skin care product delivery system.
Figure 3B:
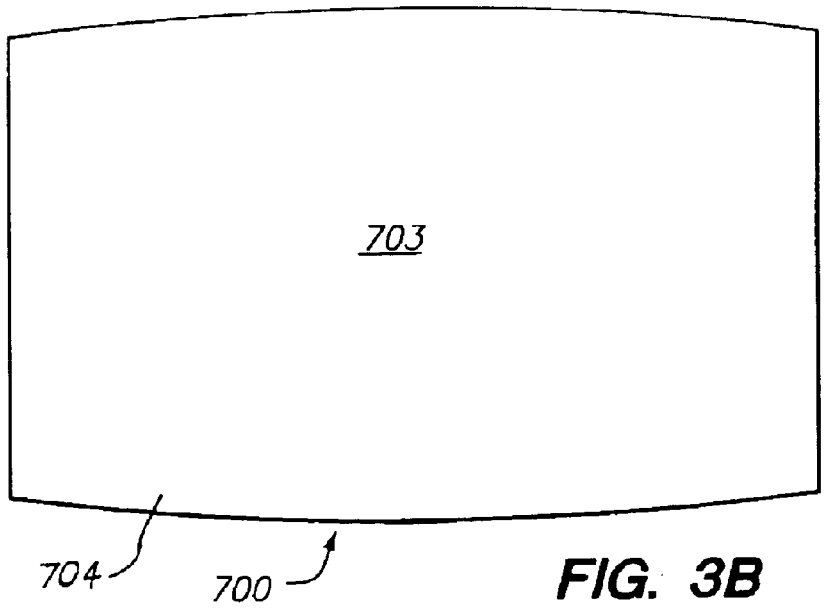
FIG. 3B is a plan view of a second side of the system of FIG. 3A.

FIG. 3A, FIG. 3B illustrate a third example embodiment of a skin care product delivery system 700. FIG. 3A is a plan view of system 700. A carrier cover 704 comprises a plurality of holes through which project product cavities 706 of a product carrier that is removably affixed under the carrier cover 704. The product cavities 706 and corresponding holes in the carrier cover 704 are arranged in another alternative configuration, size and shape. A graphical dividing line 708 may define first and second portions of the carrier cover 704. Access to the product carriers is obtained by breaking a first pair of perforation lines 710A, 712A, and perforated portions of line 708 and removing a first product carrier, or by breaking a second pair of perforations 710B, 712B and the perforated portions of line 708 and removing a second product carrier.

FIG. 3B is a plan view of the carrier cover 704 illustrating a face 703 that may receive a name, logo or other textual or graphic information. In some embodiments, face 703 may be termed a "top" face of system 700 because, with such graphic information, it may be the first face encountered by a consumer in a purchasing situation; however, the term "top" is used for convenience and is not restrictive or indicative of a required orientation for system 700.

Figure 4A:
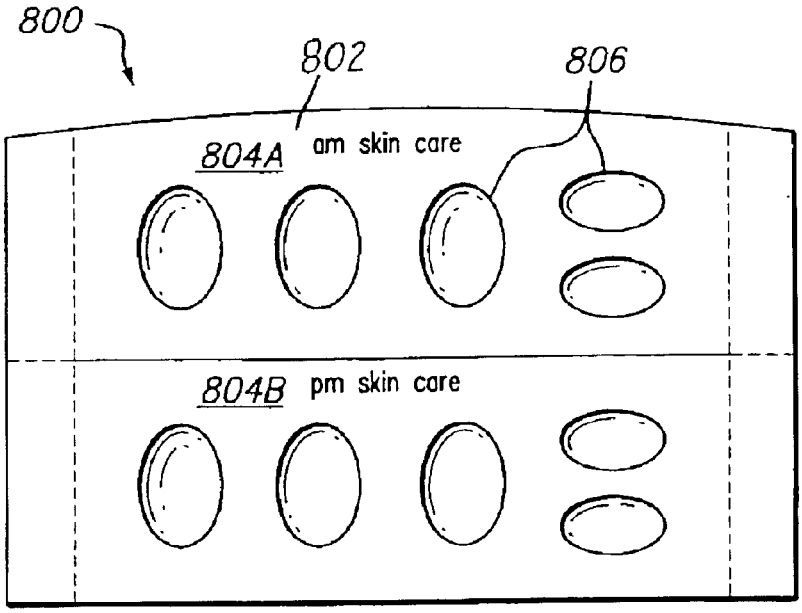
FIG. 4A is a plan view of a first side of a fourth embodiment of a skin care product delivery system.
Figure 4B:
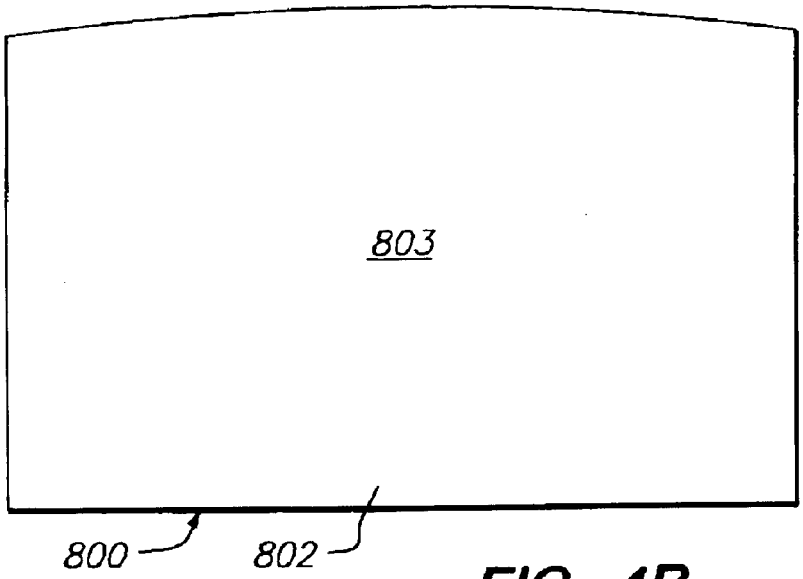
FIG. 4B is a plan view of a second side of the embodiment of FIG. 4A.

FIG. 4A and FIG. 4B are diagrams of a fourth example embodiment of a skin care product delivery system 800. FIG. 4A is a plan view of system 800, which comprises a carrier cover 802 having first and second portions 804A, 804B. Each of the portions 804A, 804B comprises a plurality of holes through which project product cavities 806 in another alternative configuration, size and shape.

FIG. 4B is a plan view of the embodiment of FIG. 4A illustrating the carrier cover 802 having a face 803 that may receive a name, logo or other textual or graphic information.

Figure 5A:
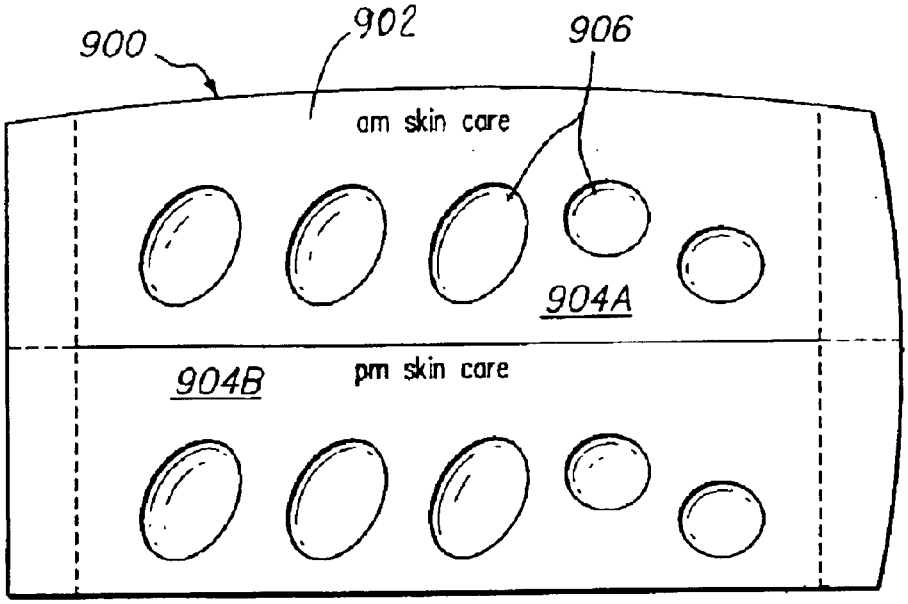
FIG. 5A is a plan view of a first side of a fifth embodiment of a skin care product delivery system.
Figure 5B:
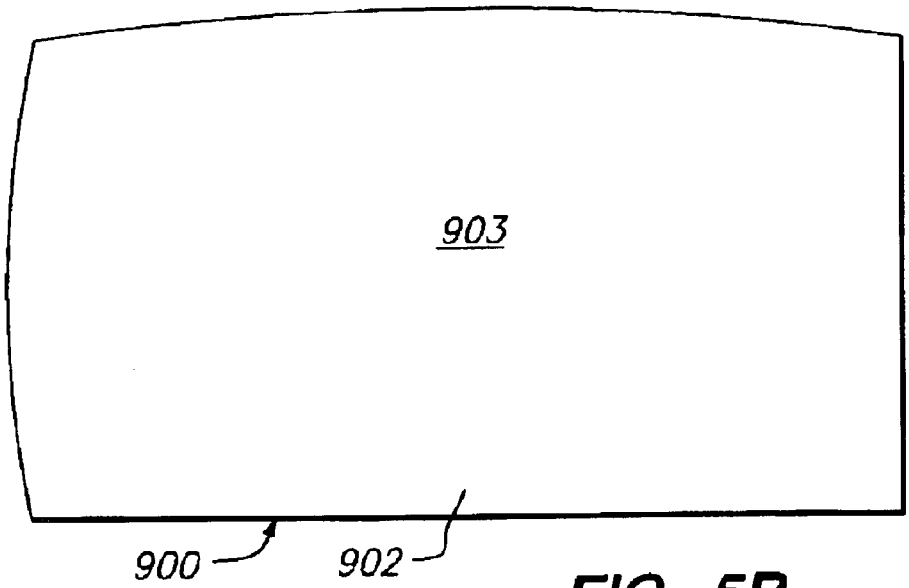
FIG. 5B is a plan view of a second side of the embodiment of FIG. 5A.

FIG. 5A and FIG. 5B illustrate a fifth example embodiment of a skin care product delivery system. FIG. 5A is a plan view of the skin care delivery system 900 generally comprising a carrier cover 902 having a first portion 904A and second portion 904B, each of which may be associated with skin care products for a different time of day or activity. FIG. 5A further illustrates another example configuration, size and shape of product cavities 906, and of the overall shape and size of carrier cover 902. FIG. 5B is a plan view of the carrier cover 902 of system 900 of FIG. 5A. The carrier cover 902 may have a face 903 that may receive a name, logo or other textual or graphic information.

In general, the structure and mechanical arrangement of the embodiments of FIGS. 4A–5B, inclusive, are similar. However, each such embodiment differs in the shape or arrangement of the product cavities. Other shapes and arrangements may be provided.

III. Extensions and Alternatives

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A skin care product delivery system, comprising:

a carrier cover;

a product carrier that is removably affixed to the carrier cover;

a plurality of spaced-apart cavities formed in the product carrier;

a quantity of skin care product in each of the cavities; and one or more seals over the cavities;

wherein each of the cavities contains a functionally different skin care fluid.

2. A system as recited in claim 1, wherein each different skin care fluid addresses a different skin care need that may arise in a particular period of time.

3. A system as recited in claim 1, wherein the carrier cover comprises:

a planar sheet comprising a plurality of holes through which the cavities may project and having a slot for receiving a closure tab and a foldable score line;

a closure tab extending outwardly from the sheet, wherein folding the cover along the score line and inserting the closure tab into the slot results in removably closing the cover over the sheet and the cavities.

4. A system as recited in claim 1, wherein the carrier cover comprises a first portion and a second portion, the first portion associated with a first plurality of cavities in the product carrier that hold a first set of skin care products for use during a first time period, the second portion associated with a second plurality of cavities in the product carrier that hold a second set of skin care products for use during a second time period.

5. A system as recited in claim 1, wherein the product carrier comprises a first plurality of cavities that hold skin care products for use during a morning time period, and a second plurality of cavities that hold skin care products for use during an afternoon or evening time period.

6. A system as recited in claim 1, wherein the product carrier comprises a first plurality of cavities that hold a first set of skin care products for use during a first activity, and a second plurality of cavities that hold a second set of skin care products for use during a second activity.

7. A system as recited in claim 1, wherein the one or more seals comprise a single planar sheet of sealing material that covers all the cavities.

8. A system as recited in claim 1, wherein the one or more seals comprise a plurality of individual seals, each of the seals formed over a different one of the cavities.

9. A disposable package for providing skin care products, comprising:

a planar, water-impermeable product carrier having a first plurality of spaced-apart cavities a second plurality of spaced-apart cavities formed in the product carrier;

a once-removable cover sealed over the cavities;

a first set of skin care products in the cavities of the first portion, wherein each product in the first set is functionally different and is appropriate for use during a first time period; and a second set of skin care products in the cavities of the second portion, wherein each product in the second set is functionally different and is appropriate for use during a second time period, further comprising a carrier cover that receives and encloses the product carrier, and wherein the carrier cover comprises:

a planar sheet in which holes are formed through which the cavities may project and having a slot for receiving a closure tab and having a foldable score line;

a closure tab extending outwardly from the sheet, wherein folding the cover along the score line and inserting the closure tab into the slot results in removably closing the cover over the sheet and the cavities.

10. A package as recited in claim 9, wherein the product carrier comprises a first plurality of cavities that hold skin care products for use during a morning time period, and a second plurality of cavities that hold skin care products for use during an afternoon or evening time period.

11. A package as recited in claim 9, wherein the product carrier comprises a first plurality of cavities that hold a first set of skin care products for use during a first activity, and a second plurality of cavities that hold a second set of skin care products for use during a second activity.

12. A package as recited in claim 9, wherein the once-removable cover comprises a single planar sheet of sealing material that covers all the cavities.

13. A package as recited in claim 9, wherein the once-removable cover comprises a plurality of individual seals, each of the seals formed over a different one of the cavities.

* * * * *

UNITED STATES PATENT AND TRADEMARK OFFICE

CERTIFICATE OF CORRECTION

PATENT NO. : 6,820,744 B2
DATED : November 23, 2004
INVENTOR(S) : Lisa Hoffman

It is certified that error appears in the above-identified patent and that said Letters Patent is hereby corrected as shown below:

Column 10,
Line 44, "cavities a" should read -- cavities and a --.

Signed and Sealed this

Seventeenth Day of May, 2005

JON W. DUDAS
*Director of the United States Patent and Trademark Office*